US008763761B2

(12) United States Patent
Siikonen

(10) Patent No.: US 8,763,761 B2
(45) Date of Patent: Jul. 1, 2014

(54) ELEVATOR SYSTEMS AND METHODS FOR BUILDING EVACUATION

(75) Inventor: Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 48 days.

(21) Appl. No.: 13/539,979

(22) Filed: Jul. 2, 2012

(65) Prior Publication Data

US 2012/0267202 A1 Oct. 25, 2012

Related U.S. Application Data

(63) Continuation of application No. PCT/FI2011/050070, filed on Jan. 28, 2011.

(30) Foreign Application Priority Data

Feb. 1, 2010 (FI) ..... 20100031

(51) Int. Cl.
*B66B 1/20* (2006.01)

(52) U.S. Cl.
USPC ..... 187/384; 187/392; 187/388

(58) Field of Classification Search
USPC ..... 187/247, 248, 313, 316, 317, 380–389, 187/391–393, 396
See application file for complete search history.

(56) References Cited

U.S. PATENT DOCUMENTS

| | | | | |
|---|---|---|---|---|
| 6,000,505 | A * | 12/1999 | Allen | 187/391 |
| 7,182,174 | B2 * | 2/2007 | Parrini et al. | 182/18 |
| 7,210,564 | B2 * | 5/2007 | Kawai | 187/384 |
| 7,413,059 | B2 * | 8/2008 | Kawai | 187/384 |
| 7,461,723 | B2 * | 12/2008 | Kawai | 187/313 |
| 7,621,378 | B2 * | 11/2009 | Kawai | 187/313 |
| 7,938,232 | B2 * | 5/2011 | Hikita et al. | 187/384 |
| 8,109,368 | B2 * | 2/2012 | Manabe | 187/384 |
| 8,113,320 | B2 * | 2/2012 | Kawai et al. | 187/384 |
| 8,251,185 | B2 * | 8/2012 | Manabe | 187/384 |
| 8,281,901 | B2 * | 10/2012 | Kawai et al. | 187/392 |
| 2004/0163325 | A1 | 8/2004 | Parrini et al. | |
| 2006/0201751 | A1 | 9/2006 | Kawai | |
| 2007/0272497 | A1 | 11/2007 | Kawai | |
| 2011/0114424 | A1 | 5/2011 | Manabe | |

FOREIGN PATENT DOCUMENTS

| | | | |
|---|---|---|---|
| EP | 1849733 | A1 | 10/2007 |
| WO | WO-2005070804 | A2 | 8/2005 |
| WO | WO-2011048990 | A1 | 4/2011 |

OTHER PUBLICATIONS

International Search Report and Written Opinion.

* cited by examiner

*Primary Examiner* — Anthony Salata
(74) *Attorney, Agent, or Firm* — Harness, Dickey & Pierce, P.L.C.

(57) ABSTRACT

In a method, an evacuation state is activated, and the number of people awaiting evacuation on specific floors is determined. At least one of a number of elevator cars and of evacuation times needed for the evacuation of specific floors is calculated based on the capacity of the aforementioned one or more elevator cars and of the number of people awaiting evacuation, and floor-specific evacuation is controlled to one or more exit floors.

16 Claims, 2 Drawing Sheets

ELEVATOR SYSTEMS AND METHODS FOR BUILDING EVACUATION

CROSS-REFERENCE TO RELATED APPLICATIONS

Figure 1:
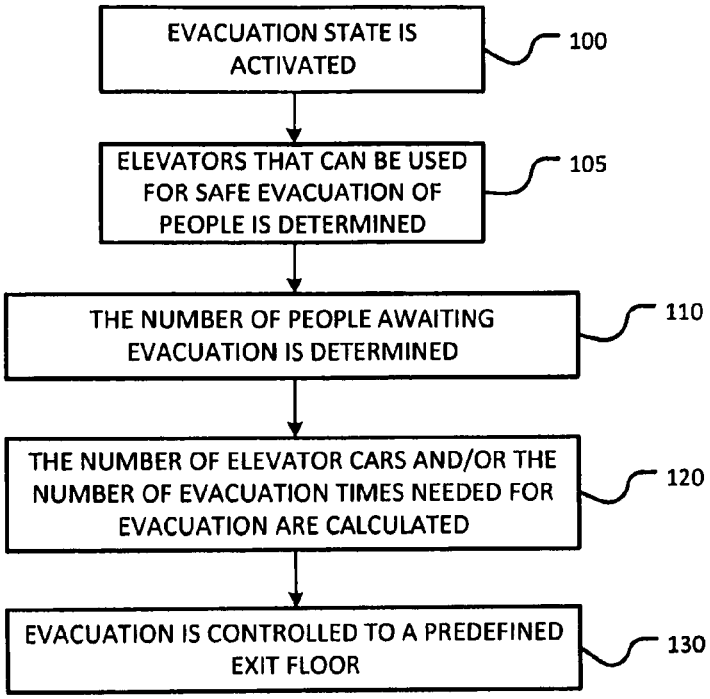

This is a Continuation of PCT/FI2011/050070 filed on Jan. 28, 2011, which is an International Application claiming priority from FI 20100031 filed on Feb. 1, 2010; the entire contents of each of which are hereby incorporated by reference.

FIELD OF THE INVENTION

The present invention relates to elevator systems. More particularly the invention relates to the evacuation of a building, or a part of it, using elevator systems.

BACKGROUND OF THE INVENTION

If an exceptional incident occurs in a building, which incident can cause danger to the users of the building, it is important to enable a safe exit from the building for the users. This kind of serious exceptional incident can be e.g. a fire, an earthquake, a bomb threat or a similar type of event, which is of danger to the people in the building. An evacuation order can be given in the building, either for certain floors of the building or for the entire building, after detecting an exceptional incident. The transport systems located in the building, such as elevators, are in this case placed in an important role.

Generally the use of elevators in the event of fire can be prohibited. This is because a fire can damage an elevator system, in which case elevators are no longer safe to use for evacuating people to the exit floor of the building. It is also possible that the elevator stops working during an elevator run, in which case the elevator car may stop between floors leaving the elevator passengers trapped. Also the extinguishing water to be used for extinguishing fires may damage the electrical parts of the system e.g. by causing short-circuits in the electronics parts of the system.

Additionally in the event of a fire it is not sensible to direct the elevator car to, and then open the doors to, a floor on which the fire has progressed to an advanced stage. In this case the safety of the people already traveling in the elevator is endangered and the time needed for evacuation becomes longer, if it can be assumed that on this kind of floor there are no longer any people awaiting evacuation.

On the other hand, if the elevator system is constructed to be such that it withstands heat well or it is protected with suitable structures, the elevator system can very well be a feasible additional aid in the evacuation of the building. In high-rise buildings this is especially prominent, because the safe evacuation of a large number of people along the stairs and out of the building is extremely slow. If the elevators can be safely and reasonably controlled also during an emergency, the evacuation time can be substantially shortened. It follows from the above that travel of the elevators in emergencies must be controlled in accordance with a special evacuation state.

When an evacuation situation arises, one awkward point is receiving reliable information about the number of people to be evacuated on each floor. Additionally, if e.g. a destination call system is in use, in which each elevator user gives his/her personal destination information to the elevator system with a separate destination call panel instead of up-down pushbuttons, each person should separately give a destination call. In this case, after each destination call the group control optimizes the routing and allocates an elevator car to each person. If the number of people to be evacuated is considerable, the group control is significantly loaded and the route selections are not necessarily optimal from the viewpoint of evacuation.

PURPOSE OF THE INVENTION

The aim of the present invention is to present a solution wherein in an evacuation state reliable floor-specific information about the number of people to be evacuated is obtained so that the evacuation can be performed quickly and efficiently. Another aim of the invention is to disclose a solution in which up-to-date guidance information relating to the evacuation and other corresponding information relating to the evacuation can be given to the people to be evacuated.

SUMMARY OF THE INVENTION

Methods and systems for evacuating at least a portion of a building are disclosed. Other embodiments of the invention are characterized by what is disclosed in the other claims. Some inventive embodiments are also presented in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

One aspect of the invention presents a method for evacuating a building or a part of it using an elevator system, which elevator system comprises one or more elevators. In the method an evacuation state is activated, which evacuation state defines at least one floor to be evacuated and at least one exit floor. When an evacuation state is prevailing the number of people awaiting evacuation on specific floors is determined; the number of elevator cars and/or of evacuation times needed for the evacuation of specific floors is calculated on the basis of the capacity of the aforementioned one or more elevator cars and of the number of people awaiting evacuation; and the floor-specific evacuation is controlled to a predefined at least one exit floor, in which control the aforementioned number of elevator cars and/or of evacuation times needed for the evacuation is taken into account. An evacuation state refers in this context to any state whatsoever prevailing in a building, which when prevailing necessitates emptying at least one floor of people to at least one exit floor.

In one embodiment of the invention, in the determination phase the number of people awaiting evacuation on a floor is determined from the number of people entered into the destination call panel of the floor.

In one embodiment of the invention, in the determination phase the number of people awaiting evacuation is determined with at least one lobby detector in the elevator lobby of the floor.

In one embodiment of the invention, the number of people awaiting evacuation on specific floors is updated after the original determination at least once when the evacuation state is active. As a result of the embodiment the elevator system receives updated information e.g. about situations in which more people to be evacuated arrive in an elevator lobby during an evacuation. On the basis of the information the elevator system can calculate more precisely the transport capacity needed for evacuating the remaining people and the duration of evacuation.

In one embodiment of the invention, information about the number of people who are awaiting evacuation on a floor is transmitted to a remote point. As a result of the embodiment firemen, for example, or other persons participating in the evacuation receive information about the numbers and locations of people to be evacuated in the building.

In one embodiment of the invention, guidance about an alternative manner of evacuation is given to people who are awaiting evacuation on a floor. As a result of the embodiment the people to be evacuated can be guided e.g. to transfer to some other floor and/or to an elevator lobby or to exit along the stairway e.g. in situations in which the safe operating time of the elevator system is not sufficient for the evacuation of all the people on a floor.

In one embodiment of the invention, information about the estimated starting time and/or finishing time of the evacuation of a floor, and/or about the number of people remaining to be evacuated, is given to people awaiting evacuation on the floor. As a result of the embodiment unnecessary panic can be avoided because the people awaiting evacuation receive information about the starting time of the evacuation of a floor as well as about the progress of the evacuation when a floor is being evacuated.

In one embodiment of the invention, in an evacuation state a predefined evacuation sequence of floors (priority sequence) is followed. As a result of the embodiment the people in the greatest danger can be evacuated first and e.g. the people on other evacuation floors can be simultaneously guided to use alternative exit routes, and thus the overall efficiency of evacuation can be improved.

The second aspect of the invention presents a system for evacuating a building or a part of it in an elevator system, which comprises one or more elevators. The system comprises an interface of the control system for activating an evacuation state; means for determining the number of people awaiting evacuation on specific floors; a control system for calculating the number of elevator cars and/or evacuation times needed for the evacuation of specific floors on the basis of the capacity of the aforementioned one or more elevator cars and of the number of people awaiting evacuation; and a control system for controlling the evacuation of specific floors to at least one exit floor specified by the evacuation state.

LIST OF FIGURES

FIG. 1 presents a flow chart of the method according to the invention according to one embodiment of the invention.

Figure 2:
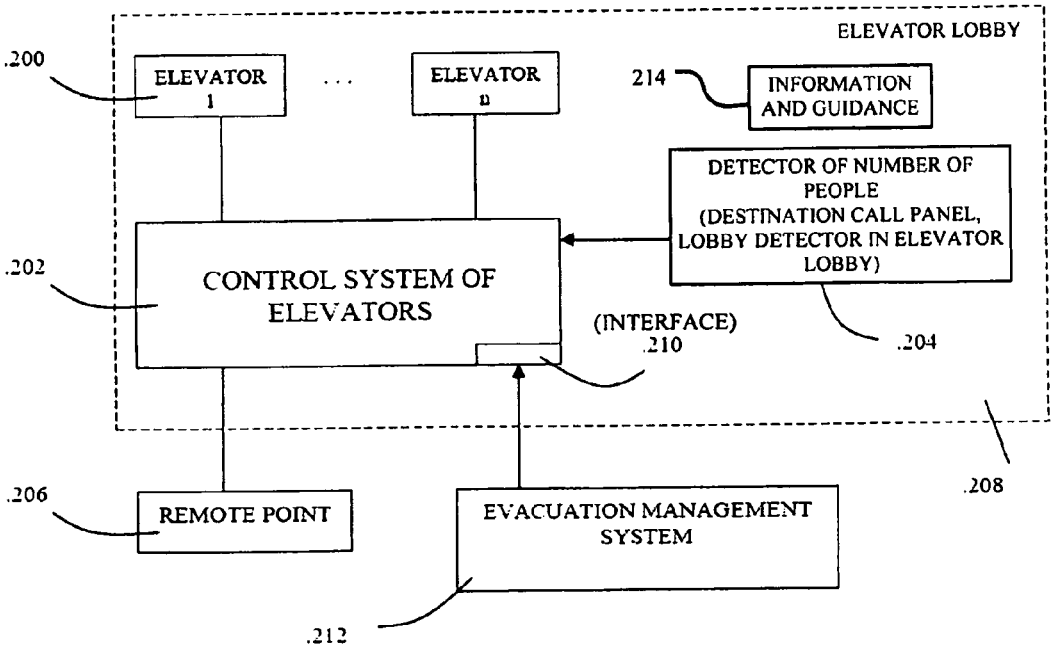

FIG. 2 presents an example of the system according to the invention.

Figure 3:
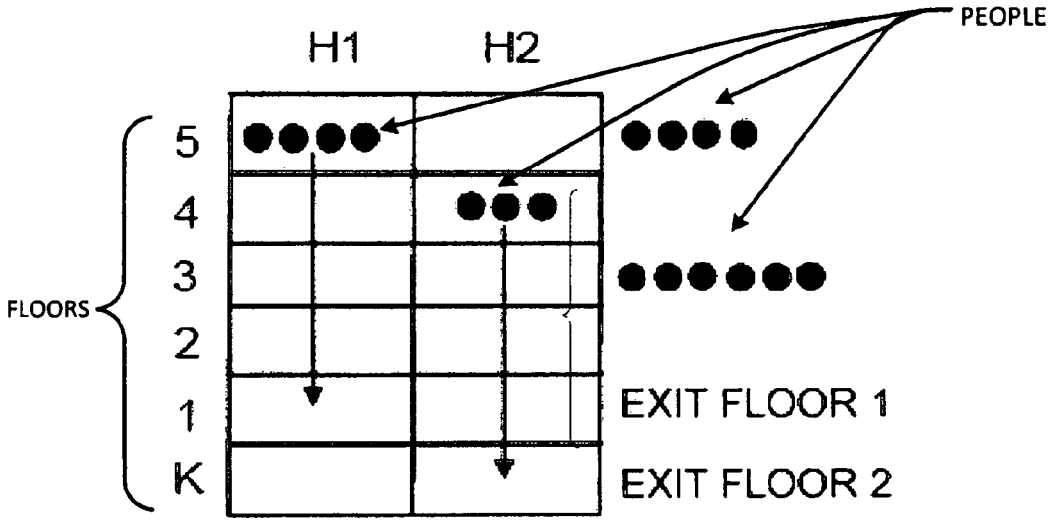

FIG. 3 presents an example of evacuation according to one embodiment of the invention.

DETAILED DESCRIPTION OF THE INVENTION

The present invention discloses an evacuation method that utilizes the elevator system when a situation or incident is detected on one or more floors of a building, which situation or incident requires that the floor is emptied of people. This type of incident can typically be a fire, an earthquake or a bomb threat. The present invention relates to the control of the elevators in a manner deviating from the normal operating state. The purpose of the system is e.g. to minimize the time spent on transporting people to at least one exit floor (which is typically the lobby floor of the building) from the floors of the building that are to be evacuated. This minimization of time cannot be achieved with the normal serving of elevator calls but instead a special evacuation state must be taken into use. This evacuation state is also different, depending on whether the elevator system is a so-called conventional system that follows up-down calls or a destination call system, in which the destination floor is given personally in the elevator lobby before even stepping into the elevator car.

An evacuation state can result from a number of different factors and these factors can also have an effect on how to proceed in an evacuation state. In an exceptional situation at least a fire incident and other exceptional situations, for example, can be distinguished from each other, because a fire may damage the operation of the elevator system making it dangerous for users. In this case the elevators can be used e.g. in so-called fireman's mode, which allows firemen and their appliances access to the fire site. Another operating mode relating to a fire can be full evacuation mode (the whole building is emptied of people), if it can be assumed that the elevator system can withstand fires well. Another type of potential threat requiring evacuation is e.g. a hurricane or a bomb threat, which have not yet damaged the infrastructure of the building when the decision to evacuate is made. In this case it can be assumed that the elevator system can safely be used for evacuation. One situation possibly requiring evacuation is also complete disconnection of the building from the electricity network. In this case of course the elevator system requires one or more reserve power sources to operate. A reserve power source can be e.g. a backup generator either for a specific elevator group or for a specific elevator, with which at least the use of some elevators for evacuation transportation after disconnection of the external current supply can be guaranteed.

In an evacuation situation relating to fires an elevator system needs diverse data, so that the control of the system knows the floors to be evacuated, the exit floors that can be used, the elevators capable of operating and an estimate of their safe operating time for evacuating floors. Smoke or temperature detectors/sensors can be utilized to inform the control system of the elevators and the fire service of the extent of the fire and of the operating condition of the elevators.

FIG. 1 presents a flow chart of the method according to the invention according to one embodiment of the invention. The flow chart describes the evacuation of a building or a part of it using an elevator system, which comprises one or more elevators. In the first phase of the method, the evacuation state (100) of the elevator system is activated. In connection with activation, the floors to be evacuated as well as the safe exit floors are determined. Additionally, in connection with activation of the evacuation state the elevators that can be used for the evacuation of people can be determined (105) and also an estimate can be made of the safe operating time of the aforementioned elevators during exceptional circumstances. If there are a number of floors to be evacuated, the priority sequence between floors is determined. When the elevator system is set to an evacuation state, the number of people awaiting evacuation on specific floors is determined (110). The determination of the number of people awaiting evacuation can be performed in many different ways. In one embodiment the determination is performed with one or more lobby detectors in the elevator lobby of each floor. In a second embodiment the elevator system is a destination-call-controlled elevator system, and in an evacuation state the number of people who are awaiting evacuation of a floor is entered with the destination call panel that is on the floor. In this case e.g. one of the people waiting in the elevator lobby for evacuation keys in an estimate of the number of people awaiting evacuation on the floor by means of the pushbuttons of the destination call panel disposed in the elevator lobby.

The number of elevator cars and/or of evacuation times (evacuation runs) needed for the evacuation is calculated (120) on the basis of the capacity of the aforementioned one or more elevator cars and of the number of people awaiting evacuation. Floor-specific evacuation is controlled (104) to one or more predefined exit floors, in which control the calculated number of elevator cars and/or of evacuation times is taken into account.

FIG. 2 presents one example of the system according to the invention. The elevator system 208 comprises a control system 202 of the elevators, which control system controls one or more elevators 200. The control system comprises an interface 210, via which the control system is connected to the evacuation management system 212 of the building. Activation of an evacuation state can occur either manually or automatically, depending on the evacuation management system and/or on the exceptional situation detected. Via the interface information about the floors to be evacuated and the priority sequence among them, about safe exit floors, about the elevators to be used for the evacuation and/or about the safe operating times of elevators can be transmitted to the control system. One or more of the aforementioned data can be saved in the control system. When an evacuation state is active, the control system 208 of the elevators provides information about the numbers of people who need evacuation on different floors. The information about the numbers of people is obtained from a detector 204 of the number of people disposed on each floor.

In one embodiment of the invention, in which a destination call panel 204 is used, with the destination call panel an estimate is given of the number of people who need evacuation on the floor in question. Since the control system 202 of the elevator is aware of the number of elevators in use and the capacity of the elevator car of each elevator, the control system 202 can calculate how many elevators and/or how many evacuation runs must be performed between the floor to be evacuated and the exit floor so that all the people who are awaiting evacuation on a floor to be evacuated can be evacuated. The elevator system can, on the basis of the information, also calculate the times to be used for the evacuation of specific floors and, on the basis of the information, make deductions about the control procedures needed.

In another embodiment of the invention the elevator system is not a destination call system and separate destination call panels are not in use. In this case e.g. one or more lobby detectors can be used as the detectors 204 of the number of people. The lobby detector or the lobby detectors monitor the number of people collected in an elevator lobby and transmit information about it to the control system 202 of the elevator. The detectors themselves can be implemented with any prior-art detector technology whatsoever.

The information about the number of people to be evacuated can be updated during an evacuation state e.g. according to when new people come into the elevator lobby to await evacuation. The updating can occur in the same way as when starting an evacuation situation, e.g. by means of a destination call panel or by using lobby detectors. When updating the number of people to be evacuated, the control system 202 can also utilize information from the car load weighing devices or from the door photocells of the elevator cars. On the basis of the information received from them it is possible to know or to estimate how many people of the people awaiting evacuation on a floor have already been evacuated. All in all the evacuation process can be an event that is dynamic and changes according to the situation, and not simply a performance executed according to parameters set in advance.

In one embodiment the control system 202 additionally transmits onwards to a remote point 206 information about the number of people needing evacuation. The remote point 206 can be e.g. a control point of the building or it can be the fire department. When the information is available at the remote point 206, the information gives important additional information in an evacuation situation e.g. to rescue personnel.

The elevator system 208 comprises floor-specific information means 214, by the aid of which different guidance and other information can be given in an evacuation situation. The guidance can be arranged via a display means that is in connection with a destination call panel or via a separate information board or sound announcement. When an evacuation state is activated, information about this is given to the people on the floors, and it is requested that an estimate is given e.g. from the destination call panel, about the number of people to be evacuated from the floor. Guidance can also request the people awaiting evacuation on a certain floor to transfer to another floor or to use the stairs e.g. in a situation in which the safe operating time of the elevators is coming to an end and not all the people can be evacuated with the elevators in the remaining time. In a second embodiment the guidance can notify the people awaiting evacuation of an estimate of when the evacuation of the floor in question will start and when the elevators will arrive to evacuate the floor. As a result of the information, unnecessary panic will not arise on the floor when e.g. the elevators are evacuating some other floor, because an estimate of the starting time of the evacuation of the floor can be transmitted to the people. When the elevators are evacuating a certain floor, by the aid of the information means disposed on the floor information determined by the elevator system about the remaining evacuation time of the floor and/or about the number of people remaining as calculated by the elevator system can be given.

FIG. 3 presents an example of evacuation according to one embodiment of the invention. The example presented in FIG. 3 comprises two elevator cars H1, H2 and six floors. Two of the floors (1, K) are specified as exit floors in an evacuation situation. The black balls in the figure indicate people awaiting evacuation. A separate evacuation state is specified for the control system of the elevators H1 and H2, which evacuation state determines how the evacuation is performed in an evacuation situation.

In the example of FIG. 3, people on two different floors (3 and 5) are awaiting evacuation. Priorities are defined for the floors such that floor 5 is evacuated first and only then floor 3. If, for example, there are 50 people on floor 5 and 30 people on floor 3 to be evacuated, the control system calculates that 5 evacuation runs are needed for evacuating floor 5 and 3 evacuation runs are needed for evacuating floor 3. The control system can also calculate an estimate of how long the evacuation of floor 5 will last, e.g. 15 minutes, and gives information about this to floor 3 with the information means (e.g. "Evacuation of floor will start in 15 minutes"). During the evacuation of floor 5 the elevator system monitors the numbers of people coming into the elevator cars, e.g. by means of car load weighing devices and/or door photocells, and shows by the aid of the information means on the floor an estimate of the number of people remaining. If the number in question differs essentially from the number of people in the elevator lobby who are to be evacuated, a person on the floor can give, e.g. by means of the destination floor panel, a new estimate of the number of people awaiting evacuation on the floor, on the basis of which estimate the control system can make new control decisions and update the information to be given with the information means. If in this case, for example, the estimated evacuation time of floor 5 becomes so long that there is insufficient time to perform the evacuation of both floors 5 and 3 within the framework of the safe operating time of the elevators, the control system can guide the people of floor 3 to transfer along stairways to the exit floor. When the elevator system detects e.g. from the signal of the car load weighing device and/or from the signal of the hall detector that there are no longer any people to be evacuated on floor 5, the control system directs the elevator cars to floor 3 for evacuating the people there to the specified exit floor. If a number of exit floors are in use (as is presented in FIG. 3), a certain exit floor can be specified separately for each evacuation floor.

In normal operating mode there are certain safety margins in the filling of the elevator car e.g. between the notified maximum load in the car (the maximum number of passengers in the elevator car) and the maximum load of the car that the equipment withstands. This also gives travel comfort to users of the elevator. In an evacuation state these safety margins can be compromised in order to achieve maximal operating efficiency. The elevator car can, for example, be accelerated and braked at the maximum power allowed by the system with no regard for the equipment.

Owing to one or more embodiments presented in the invention, reliable information about the number of people to be evacuated is obtained quickly. Thus the control of the elevator system can be optimized better and it is possible e.g. to make more accurate longer-term control decisions. In addition, by means of different guidance the efficiency of evacuation can be improved compared to before and people's sense of safety can be increased. As a result of the invention the people on a floor do not in an evacuation state need to give personal destination calls, which speeds up the evacuation and avoids unnecessary congestion in the elevator lobbies.

The invention is not only limited to be applied to the embodiments described above, but instead many variations are possible within the scope of the inventive concept defined by the claims below and the embodiments presented above can be combined with each other. Thus, for example, all the elevators of the elevator system do not necessarily need to be reserved for the evacuation of a certain floor but instead some of the elevators can be used for the evacuation of other floors and/or can be reserved for special use, such as e.g. fireman's drive.

The invention claimed is:

1. A method for evacuating at least a portion of a building using an elevator system, the method comprising:

activating an evacuation state, the evacuation state defining at least one floor to be evacuated and at least one exit floor;

determining a number of elevators safely usable for evacuating at least the portion of the building;

determining a number of people awaiting evacuation on the at least one floor;

calculating at least one of a number of elevator cars and evacuation times needed to evacuate the at least one floor based on a capacity of the elevator cars and the number of people awaiting evacuation; and controlling floor-specific evacuation to the at least one exit floor based on the at least one of the number of elevator cars and the evacuation times.

2. The method according to claim 1, wherein the number of people awaiting evacuation is determined based on a number of people entered into a destination call panel.

3. The method according to claim 1, wherein in the number of people awaiting evacuation is determined by at least one lobby detector in an elevator lobby.

4. The method according to claim 1, wherein the number of people awaiting evacuation is updated after an initial determination at least once when in the evacuation state.

5. The method according to claim 1, further comprising:

transmitting, to a remote point, information about the number of people awaiting evacuation on a floor among the at least one floor to be evacuated.

6. The method according to claim 1, further comprising:

providing guidance about an alternative manner of evacuation to people awaiting evacuation on a floor among the at least one floor to be evacuated.

7. The method according to claim 1, further comprising:

providing, to people awaiting evacuation on a floor among the at least one floor to be evacuated, information about at least one of, an estimated starting time of the evacuation of the floor, a remaining evacuation time of the floor, and a number of people to be evacuated.

8. The method according to claim 1, further comprising:

following an evacuation sequence of floors in the evacuation state.

9. A system for evacuating at least a portion of a building using an elevator system, the system comprising:

a control system for determining, in an evacuation state, a number of elevators safely usable for evacuating at least the portion of the building, and for calculating at least one of a number of elevator cars and evacuation times needed to evacuate at least one floor of the building based on a capacity of the elevator cars and a number of people awaiting evacuation on the at least one floor;

an interface to the control system for activating the evacuation state; and a control system for controlling the evacuation of the at least one floor to at least one exit floor.

10. The system according to claim 9, wherein the system further comprises:

at least one destination call panel for entering the number of people awaiting evacuation.

11. The system according to claim 9, wherein the system comprises:

at least one lobby detector for determining the number of people awaiting evacuation.

12. The system according to claim 9, wherein the control system updates the number of people awaiting evacuation on a floor among the at least one floor after an initial determination at least once during the evacuation state.

13. The system according to claim 9, wherein the control system transmits, to a remote point, information about the number of people awaiting evacuation on a floor among the at least one floor.

14. The system according to claim 9, wherein the system provides guidance about an alternative manner of evacuation to people awaiting evacuation on a floor among the at least one floor.

15. The system according to claim 9, wherein the system provides, to people awaiting evacuation on a floor among the at least one floor, information about at least one of, an estimated starting time of the evacuation of the floor, a remaining evacuation time of the floor, and a number of people to be evacuated.

16. The system according to claim 9, wherein the control system follows an evacuation sequence of floors in the evacuation state.

* * * * *